US005984736A

United States Patent [19]

Sakurai et al.

[11] Patent Number: 5,984,736

[45] Date of Patent: Nov. 16, 1999

[54] PRESSURE CONTACT CONNECTOR

[75] Inventors: Toshikazu Sakurai; Syuji Kosuge, both of Yokkaichi, Japan

[73] Assignee: Sumitomo Wiring Systems, Ltd., Japan

[21] Appl. No.: 09/033,089

[22] Filed: Mar. 2, 1998

[30] Foreign Application Priority Data

Mar. 3, 1997 [JP] Japan ..... 9-048086

[51] Int. Cl.[6] ..... H01R 13/432

[52] U.S. Cl. ..... 439/748; 439/746

[58] Field of Search ..... 435/743, 744, 435/746, 747, 748, 749

[56] References Cited

U.S. PATENT DOCUMENTS 3,566,342 2/1971 Schmitt et al. ..... 439/744
3,976,348 8/1976 Simmons ..... 339/74 R
4,781,628 11/1988 Detter et al. ..... 439/748
5,695,368 12/1997 Joly et al. ..... 439/748

FOREIGN PATENT DOCUMENTS 6-89748 3/1994 Japan .
6-215809 8/1994 Japan .

*Primary Examiner*—Lincoln Donovan
*Attorney, Agent, or Firm*—Banner & Witcoff, Ltd.

[57] ABSTRACT

When a pressure contact terminal fitting 20 is correctly inserted, a protruding member 26 makes contact with a receiving member 16 to resist a pressing-in force applying on the posterior end of the terminal fitting 20. Since the receiving member 16 and the protruding member 26 are located approximately in the center along the lengthwise direction of the terminal fitting 20, the terminal fitting is less likely to buckle than the case where the fitting force is resisted by the anterior end of the terminal fitting.

14 Claims, 4 Drawing Sheets

PRESSURE CONTACT CONNECTOR

TECHNICAL FIELD

The present invention relates to a pressure contact electrical connector.

BACKGROUND TO THE INVENTION

FIG. 7 of this specification shows a prior pressure contact connector. It comprises a connector housing 1 and a female pressure contact terminal fitting 2, the female terminal fitting 2 being housed inside a cavity 3 formed in the connector housing 1. The female terminal fitting 2 has a long and narrow box shape, an electric wire W making pressure contact with a pressure contact blade 4 formed at its posterior end. A resilient contact member 5 at an anterior end allows a tab (not shown) of a corresponding terminal fitting to be fitted thereto.

The operation of housing the female terminal fitting 2 into the cavity 3 is performed by an automatic device. A posterior end face of the female terminal fitting 2 is pushed by a pushing member (not shown) of the automatic device into the cavity 3 from an opening in the posterior face of the connector housing 1. The female terminal fitting 2, when pushed in this manner, makes contact with an anterior face wall 3A of the cavity 3. A receiving face 6 of the automatic device makes contact with the anterior face wall 3A. Accordingly, a pressing-in force that applies from the automatic device on to the posterior end face of the female pressure contact terminal fitting 2 is resisted by the receiving face 6 via the anterior face wall 3A of the cavity 3, and as a result the female pressure contact terminal fitting is clamped from its anterior and posterior ends.

However, since the female terminal fitting 2 forms a long and narrow box shape in the anterior-posterior direction, in the case where the pressing-in force from the automatic device is strong, there is a possibility of the female terminal fitting 2 buckling under the force and changing shape inside the cavity 3.

The present invention has been developed after taking the above problem into consideration, and aims to prevent change of shape due to buckling of a pressure contact terminal fitting when it is inserted into a cavity.

SUMMARY OF THE INVENTION

According to the present invention there is provided a pressure contact connector comprising a housing having a cavity and an elongate terminal fitting insertable into the cavity by the application of an axial fitting force to the proximal end of the terminal fitting, the terminal fitting having a distally facing step provided on an outer surface and the cavity having a proximally facing abutment face for engaging the step and in use receiving the fitting force, wherein the step is provided intermediate the distal and proximal ends of the terminal fitting.

In the present invention, when the terminal is fully inserted into the cavity, a reactive force which balances the fitting force, acts upon the terminal fitting at the step. Thus only a proximal portion of the terminal fitting is subject to compressive stress and hence is less susceptible to buckling when compared to prior art terminal fittings.

A lance engageable with a stopping face may be provided to retain the terminal fitting within the cavity. In a preferred embodiment the lance is provided on the terminal fitting and the stopping face within the cavity. The abutment face may be provided by the cavity being stepped so as to correspond to the configuration of the terminal fitting or, in an alternative embodiment, provided by a protrusion from a wall of the cavity. In the latter case the protrusion may also serve as the lance stopping face.

The step in the outer surface of the terminal fitting may, in a preferred embodiment, be provided midway between the ends of the fitting. In order to guide the insertion of the terminal fitting into the cavity the abutment face may be provided with a tapered guide surface which extends distally into the cavity.

BRIEF DESCRIPTION OF DRAWINGS

Other features of the invention will be apparent from the following description of a preferred embodiment, shown by way of example only in the accompanying drawings in which.

DESCRIPTION OF PREFERRED EMBODIMENTS

Figure 1:
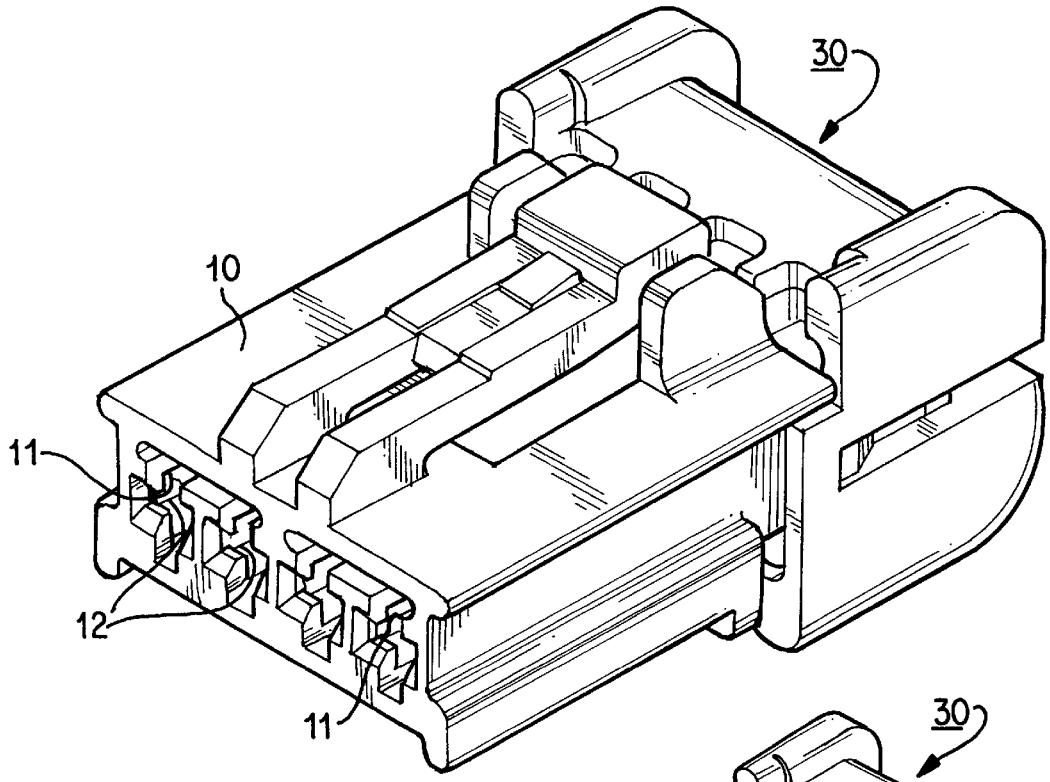
FIG. 1 is a diagonal view showing the assembled state of a first embodiment of the invention.
Figure 2:
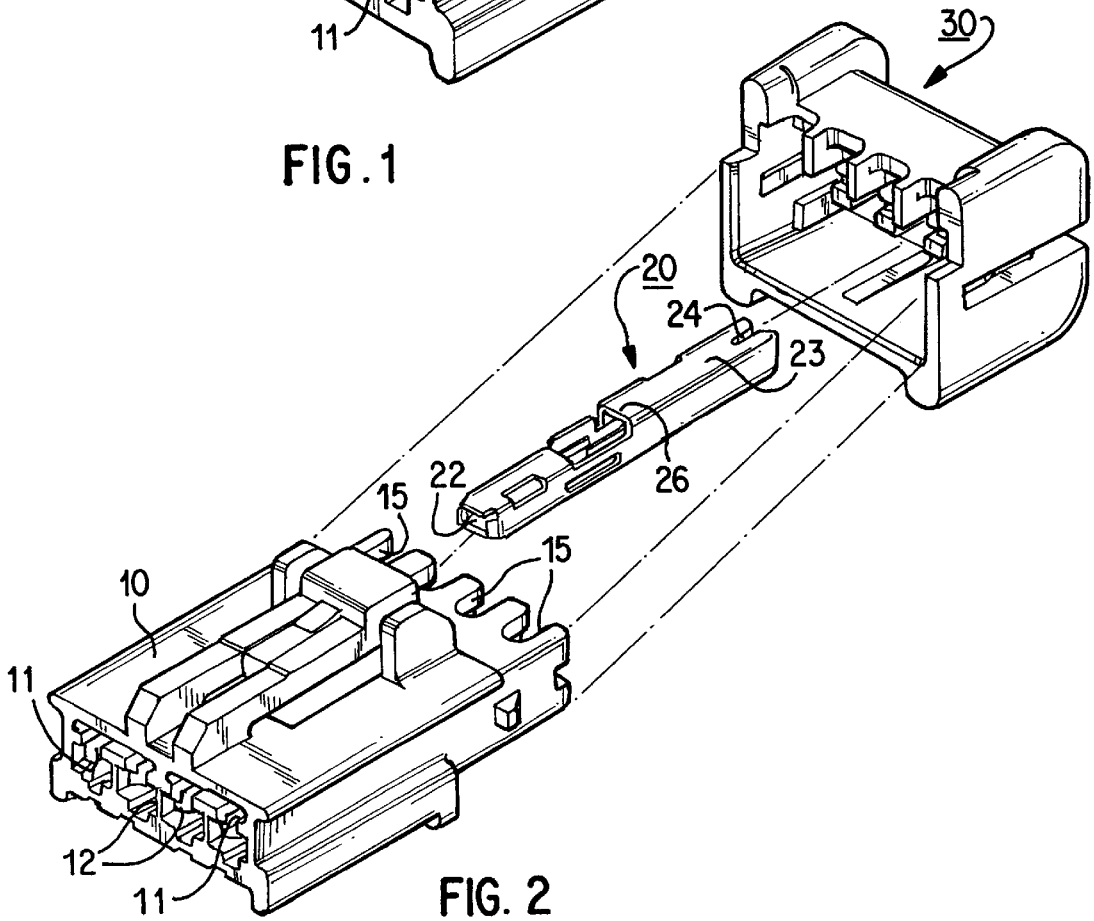
FIG. 2 is a diagonal view of the first embodiment showing a state where a pressure contact terminal fitting and a cover have been removed from a connector housing.
Figure 3:
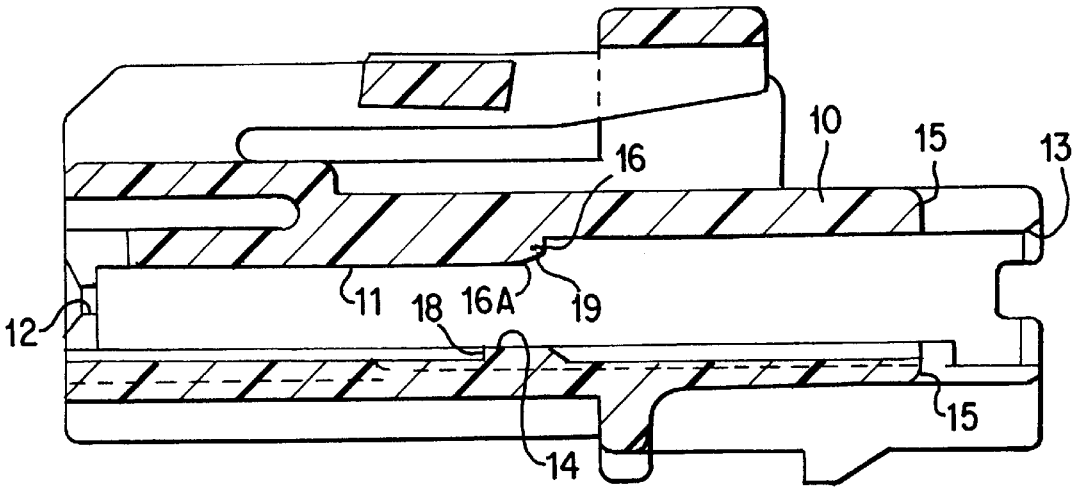
FIG. 3 is a cross-sectional view showing the connector housing of the first embodiment.
Figure 4:
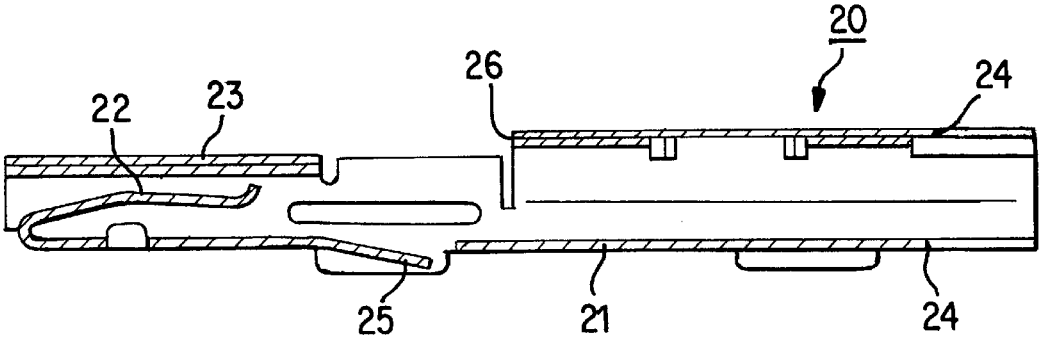
FIG. 4 is a cross-sectional view showing the pressure contact terminal fitting of the first embodiment.
Figure 5:
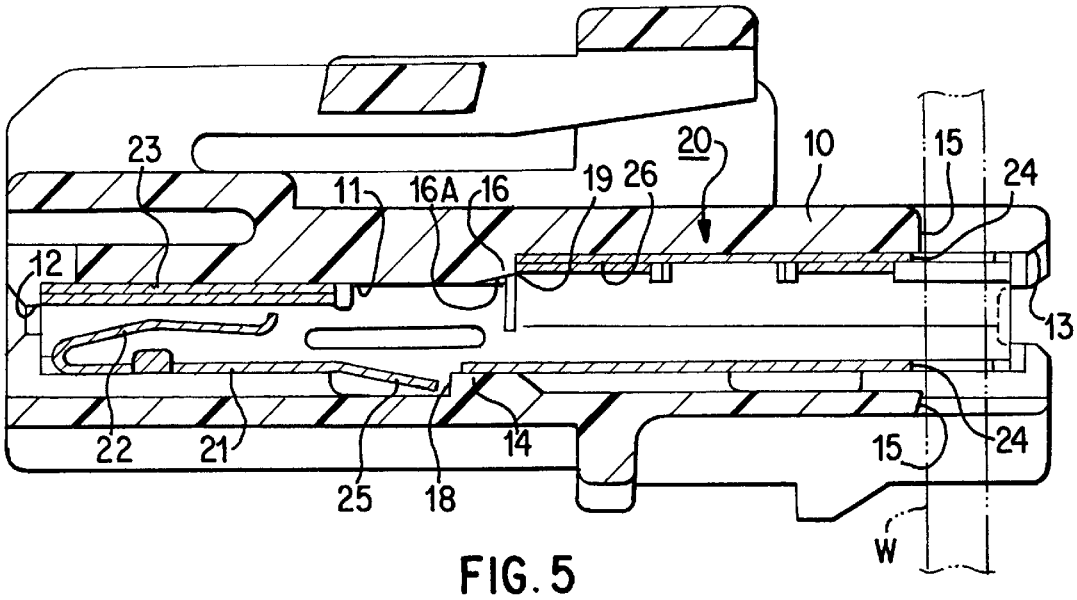
FIG. 5 is a cross-sectional view of the first embodiment showing a state where the pressure contact terminal fitting is fitted to the connector housing.

A first embodiment of the present invention is explained hereinbelow, with reference to FIGS. 1 to 5.

A pressure contact connector comprises a connector housing 10, female pressure contact terminal fittings 20 housed in the connector housing 10, and a cover 30 that covers the pressure contact portions of electric wires W in the female terminal fittings 20.

A plurality of cavities 11 are aligned to the left and right inside the connector housing 10, these cavities 11 opening out to the anterior and posterior end faces of the connector housing 10. A pressure contact terminal fitting 20 is inserted into each cavity 11. The opening at the anterior end of each cavity 11 forms a tab receiving hole 12 into which a tab of a corresponding male terminal fitting (not shown) is inserted, and the posterior end of each cavity 11 forms an insertion hole 13 for inserting the pressure contact terminal fitting 20.

The base face of each cavity 11 has a stopping member 14 protruding therefrom, the pressure contact terminal fitting 20 being prevented from being removed from the cavity 11 when the usual resilient lance 25 of the pressure contact terminal fitting 20 is engaged by a stopping face 18 of the stopping member 14.

The posterior end of the connector housing 10 has an electric wire receiving member 15 formed thereon by arranging its upper face and lower faces into U shapes. Each electric wires W is clamped in this electric wire receiving member 15 and thus make pressure contact with the pressure contact terminal fittings 20.

The pressure contact terminal fitting 20 forms a box shape in the anterior-posterior direction. The anterior end of the terminal fitting 20 has a resilient contact member 22 formed thereon by folding inwards the anterior portion of a lower face plate 21, the tab inserted from the tab receiving hole 12 of the connector housing 10 reaching a state of contact by being resiliently clamped between the contact member 22 and an upper face plate 23.

The posterior end of the terminal fitting 20 has pressure contact blades 24 formed in a cut away shape by opening into the posterior ends of the upper face plate 23 and the lower face plate 21. These pressure contact blades 24 correspond to the electric wire receiving member 15 of the connector housing 10. When an electric wire W is inserted vertically from the posterior side into the electric wire receiving member 15, the insulating cover of the electric wire W is cut and the core wire makes pressure contact with the blades 24, resulting in an electrically connected state.

The lower face plate 21 of the pressure contact blade 20 has a lance 25 protruding diagonally downwards thereon by cutting away a portion of it. When the pressure contact terminal fitting 20 is inserted into the correct position in the cavity 11, the lance 25 is engaged by the stopping member 14 and as a result the pressure contact terminal fitting is supported in an unremovable state.

The pressure contact connector of the present invention has means for preventing change of shape of the terminal fitting 20 due to buckling. The roof face of the cavity 11 has, along the anterior-posterior direction, a step-shaped difference in height approximately in its central position. The height of the posterior part of the roof face is greater than that of the anterior part. The portion constituting the stepped portion which is the boundary between the different heights forms a receiving member 16 having an abutment face 19 for receiving and resisting a pressing force that applies on the pressure contact fitting 20. Further, the receiving member 16 has a tapered guiding face 16A formed so as to be inclined downwards in an anterior direction.

The height of the upper face plate 23 of the pressure contact terminal fitting 20 is also step shaped in correspondence with the roof face of the cavity 11, the posterior end being higher than the anterior side. This stepped position forms a protruding member 26 that applies a force against the abutment face 19. The contact face that makes contact with the abutment face 19 is made from a folded over end face of the upper face plate 23.

The distance from the receiving member 16 of the cavity 11 to the inner end face is slightly greater than the distance between the protruding member 26 of the terminal fitting 20 and the anterior end face. Consequently, in the state where the protruding member 26 makes contact with the abutment face 19, the anterior end face of the pressure contact terminal fitting 20 and the inner end face of the cavity 11 are in a non-contacting state.

Operation of the present embodiment is as follows. When the pressure contact terminal fitting 20 is to be inserted into the cavity 11, the receiving face of the automatic device (not shown) is brought against the anterior end face of the connector housing 10 and a pressing-in jig (not shown) is brought against the posterior end face of the pressure contact terminal fitting 20, which is pushed in from the pushing-in hole 13. When the pressure contact terminal fitting 20 is pushed up to the correctly housed position, the protruding member 26 makes contact with the abutment face 19 of the receiving member 16, and accordingly any further pushing in of the pressure contact terminal fitting 20 is prevented from occurring.

At this juncture, the pressing force applied on the pressure contact terminal fitting 20 by the automatic device is stopped, the pressure contact terminal fitting 20 being clamped between the posteriorly located pressing-in jig and the receiving member 16. Since this clamping force acts in the pressing-in direction, i.e., along the lengthwise direction of the terminal fitting 20, there is a possibility of its buckling and changing shape in the case where the rigidity of the clamping region is weak relative to the clamping force.

However, in the present embodiment, since the receiving member 16 which receives the pressing-in force is located approximately at the centre along the lengthwise direction of the terminal fitting 20, compared to the prior art case where the pressing-in force is received at the anterior end of the terminal fitting, the clamping region is reduced to approximately half the length of the terminal fitting 20, resulting in greater rigidity. Accordingly, buckling of the terminal fitting 20 resulting from the application of the pressing-in force can be prevented with certainty.

Further, in the present embodiment, since the receiving member 16 has the tapered guiding face 16A formed thereon, when the pressure contact terminal fitting 20 is inserted, it is prevented from being caught by the upper angled portion of the anterior edge of the pressure contact terminal fitting 20, thereby making the pressing-in operation smoother.

Figure 6:
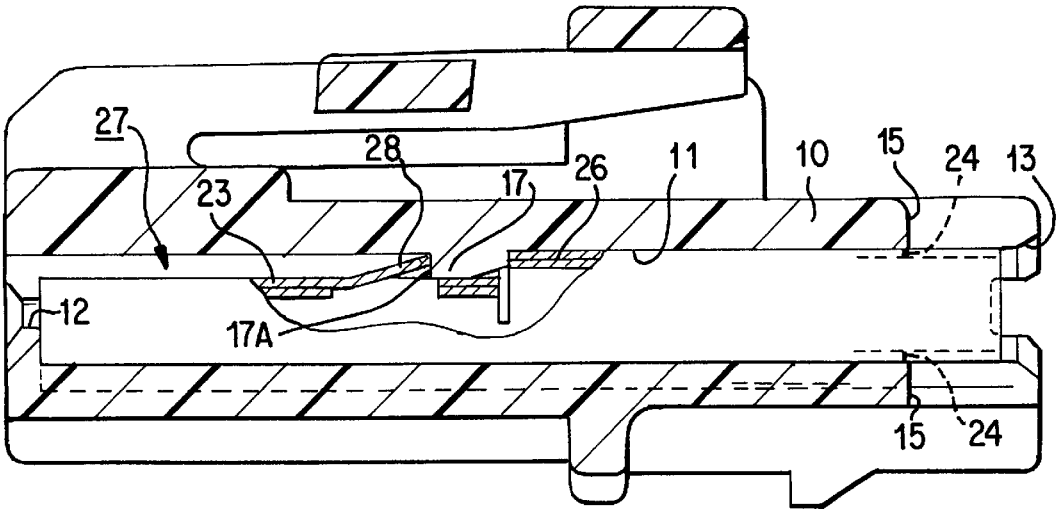
FIG. 6 is a cross-sectional view of a second embodiment showing a state where a pressure contact terminal fitting is fitted to a connector housing.
Figure 7:
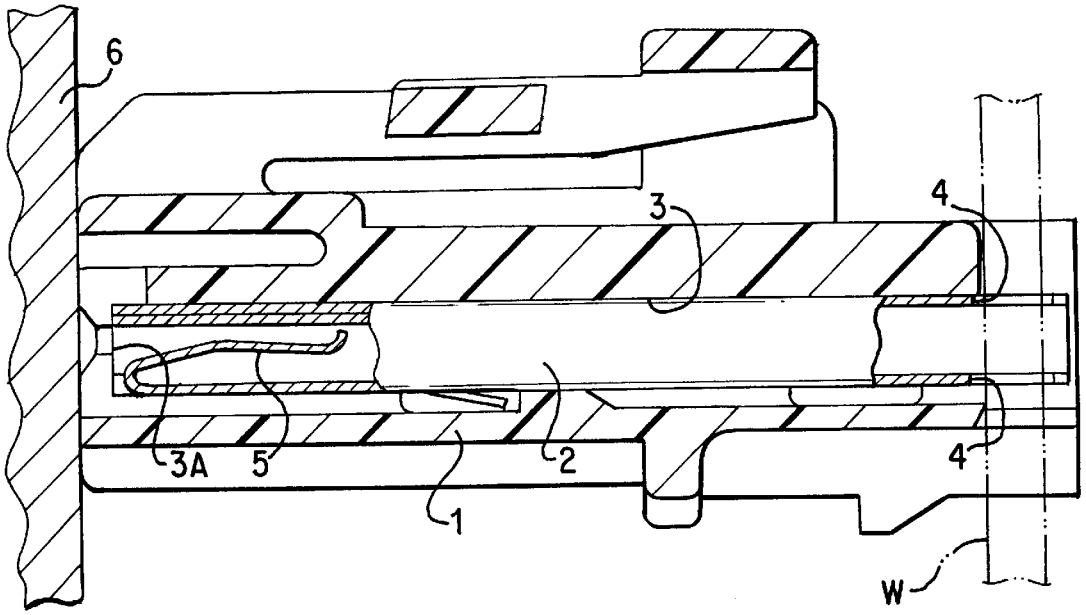
FIG. 7 PRIOR ART
FIG. 7 is a cross-sectional view of a prior pressure contact connector.

A second embodiment of the present invention is now described with the aid of FIG. 6.

The second embodiment differs from the first embodiment with respect to the receiving member. Since the rest of the configuration is the same, the same numbers are accorded to the corresponding parts, and an explanation of the configuration, operation and effects thereof omitted.

In the second embodiment, the heights of the anterior and posterior ends of the roof of a cavity 11 are the same, a receiving member 17 partially protruding downwards from the roof face, as illustrated. When a pressure contact terminal fitting 27 is inserted, a protruding member 26 thereof makes contact with the posterior abutment face 19 of the receiving member 17, a pressing-in force from a pressing-in jig (not shown) being resisted by the receiving member 17.

Further, the space which extends along the roof face and which is located anteriorly with respect to the receiving member 17 forms a bending space for a lance 28 formed on the upper face of the pressure contact terminal fitting 27, the anterior face of the receiving member 17 facing the bending space and forming a stopping face 17A. When the pressure contact terminal fitting 20 is inserted into the correct fitting position, the lance 28 is engaged by the stopping face 17A, and as a result the pressure contact terminal fitting 20 is maintained in a stopped state. In other words, the receiving member 17 moves in cooperation with the lance 28 and consequently also serves to stop the pressure contact terminal fitting 20.

As described in embodiment 2, in the case where the receiving member 17 and the lance 28 are provided on the same side (upper side), these serve together to mutually stop the lance 28 and the receiving member 17. Accordingly, compared to the case where the receiving member and the lance are located on mutually opposite sides, miniaturization (reducing the height) becomes possible.

The present invention is not limited to the embodiments described above. For example, the possibilities described below also lie within the technical range of the present invention. In addition, the present invention may be embodied in various other ways without deviating from the scope thereof.

(1) Although in the above embodiments a case was explained where the pressure contact terminal fitting is a female terminal fitting, the present invention also applies in the case where a maie pressure contact terminal fitting is inserted into the cavity.

(2) Although in the above embodiments one protruding member and one receiving member are provided, according to the present invention, a plurality of protruding members and receiving members may equally be provided.

(3) Although in the above embodiments, as a means for stopping the pressure contact terminal fitting a lance is formed on the pressure contact terminal fitting and this lance is stopped by a stopping face located in the cavity, according to the present invention, the lance may equally be provided in the cavity so that the lance is stopped by the pressure contact terminal fitting itself.

We claim:

1. A pressure contact connector comprising a housing having a cavity therein and a wire receiving member formed on a rear end of the housing, and an elongate terminal fitting insertable into the cavity in a forward axial direction and having a front end with a connecting portion adapted to couple to a complimentary terminal fitting and a rear end with a pair of contact blades aligned with the wire receiving member, the pressure contact blades making pressure contact with an electric wire when the electric wire is pressed into engagement with the pressure contact blades in the forward axial direction, the terminal fitting further having a forwardly facing step provided on an outer surface thereof, and the cavity having a rearwardly facing abutment face for engaging said step and in use receiving and resisting forward axial forces on the terminal fitting and preventing forward advancement of the terminal fitting, the step being provided intermediate said rear and front ends of the terminal fitting.

2. A connector according to claim 1 wherein a projecting lance is provided on one of the housing or the terminal fitting, and a stopping face engageable by the lance is provided on the other of the housing or terminal fitting.

3. A connector according to claim 2 wherein the lance is on the terminal fitting and the stopping face is provided by said cavity.

4. A connector according to claim 3 wherein the stopping face comprises a step in a wall of the cavity.

5. A connector according to claim 3 wherein said cavity has a protrusion therein, said abutment face being on one side thereof and said stopping face being on an opposite side thereof.

6. A connector according to claim 4 wherein the abutment face and step are on opposite sides of the cavity.

7. A connector according claim 1 wherein said step is provided midway between the ends of the terminal fitting.

8. A connector according to claim 1 wherein the abutment face has a tapered guide surface extending distally into the cavity, the guide surface serving to guide the distal end of the terminal fitting in a distal direction.

9. A connector according to claim 1 wherein the terminal fitting is box shaped in cross-section.

10. A connector according claim 2 wherein said step is provided midway between the ends of the terminal fitting.

11. A connector according claim 3 wherein said step is provided midway between the ends of the terminal fitting.

12. A connector according to claim 5 wherein the abutment face has a tapered guide surface extending distally into the cavity, the guide surface serving to guide the distal end of the terminal fitting in a distal direction.

13. A connector according to claim 6 wherein the abutment face has a tapered guide surface extending distally into the cavity, the guide surface serving to guide the distal end of the terminal fitting in a distal direction.

14. A pressure contact connector comprising:

a housing having a cavity therein, said cavity including a rearwardly facing abutment face and a front end having an aperture, said abutment face being spaced from said front end a first distance; and a terminal fitting in said cavity, said terminal fitting including a rear portion adapted to connect to a wire, a front portion adapted to couple to a complementary terminal fitting, a forward face opposed to said front end of the cavity, and a box-shaped portion having two pair of opposed generally planar sidewalls, one of said sidewalls terminating intermediate said front and rear portions of the terminal to define a forwardly facing step, said step being spaced laterally beyond said front portion, said step abutting said abutment face to resist forwardly directed forces on the terminal fitting and prevent forward advancement of the terminal fitting, and said step being spaced from said forward face a second distance which is less than said first distance.

* * * * *